US006873236B2

(12) United States Patent
Shah et al.

(10) Patent No.: US 6,873,236 B2
(45) Date of Patent: Mar. 29, 2005

(54) FAULT CURRENT LIMITER

(75) Inventors: Manoj Ramprasad Shah, Latham, NY (US); William James Premerlani, Latham, NY (US); Patricia Chapman Irwin, Altamont, NY (US); Guanzhong Gao, Schenectady, NY (US); Nancy Ellen Frost, Ballston Lake, NY (US); Karen Broadwell Lausier, Terryville, CT (US)

(73) Assignee: General Electric Company, Niskayuna, NY (US)

( * ) Notice: Subject to any disclaimer, the term of this patent is extended or adjusted under 35 U.S.C. 154(b) by 212 days.

(21) Appl. No.: 09/682,852

(22) Filed: Oct. 24, 2001

(65) Prior Publication Data

US 2003/0076212 A1 Apr. 24, 2003

(51) Int. Cl.[7] ..... H01F 27/10

(52) U.S. Cl. ..... 336/58; 336/57; 336/206; 336/213

(58) Field of Search ..... 336/57, 58, 206, 336/213, 65, 60, 55; 361/19, 10, 11, 57, 58, 141

(56) References Cited

U.S. PATENT DOCUMENTS

| | | | | | |
|---|---|---|---|---|---|
| 3,957,329 | A | * | 5/1976 | McConnell | 361/16 |
| 4,031,457 | A | | 6/1977 | Oberbeck | |
| 4,058,761 | A | | 11/1977 | Friedlander | |
| 4,122,385 | A | | 10/1978 | Oberbeck | |
| 4,152,637 | A | | 5/1979 | Oberbeck et al. | |
| 4,155,034 | A | | 5/1979 | Logan | |
| 4,327,311 | A | * | 4/1982 | Wroblewski | 315/244 |
| 4,377,833 | A | | 3/1983 | Udren | |
| 4,437,082 | A | * | 3/1984 | Walsh et al. | 336/58 |
| 4,523,249 | A | | 6/1985 | Arimoto | |
| 4,566,053 | A | | 1/1986 | Strickland, Jr. | |
| 4,922,156 | A | * | 5/1990 | Turcotte et al. | 315/244 |
| 4,994,932 | A | * | 2/1991 | Okamoto et al. | 361/19 |
| 5,450,266 | A | * | 9/1995 | Downie | 361/19 |
| 5,461,772 | A | * | 10/1995 | Puri | 29/605 |
| 5,561,410 | A | * | 10/1996 | Toki | 336/200 |
| 5,617,280 | A | * | 4/1997 | Hara et al. | 361/19 |
| 5,789,907 | A | | 8/1998 | Casagrande | |
| 6,147,580 | A | * | 11/2000 | Rettew et al. | 336/60 |
| 6,160,464 | A | * | 12/2000 | Clarke et al. | 336/60 |
| 6,275,365 | B1 | * | 8/2001 | Kalsi et al. | 361/19 |

FOREIGN PATENT DOCUMENTS

EP 1030428 A1 * 1/2000

OTHER PUBLICATIONS

General Electric Company "Means for Reducing Short–Circuit Duty " Current–Limiting Reactors & Special Winding Arrangements of Components, 1958, 1959 & 1964, 7 Sheets.

* cited by examiner

*Primary Examiner*—Anh Mai
(74) *Attorney, Agent, or Firm*—Ann M. Agosti; Patrick K. Patnode

(57) ABSTRACT

A fault current limiter (FCL) comprises: an air core flat clock spiral inductor comprising wound electrically conductive material and insulated turns; and two terminations configured for attaching the spiral inductor in series with a power carrying conductor.

9 Claims, 4 Drawing Sheets

FAULT CURRENT LIMITER

BACKGROUND OF INVENTION

The invention relates generally to fault current limiting.

When power is brought into a building, the components of the building's power system must be able to handle the possibility of a fault or sudden short circuit. In some systems, a fault can result in currents as high as 200 kA (kiloamps). Circuit breakers designed to withstand 200 kA short circuit currents are expensive.

In one conventional technique for reducing fault current in an electric power system, for example, fused circuit breakers have been used. Fused circuit breakers have several limitations in that fused circuit breakers need to be manually reset, resulting in longer power outage times, and in that fused circuit breakers are expensive to buy as well as maintain.

Another conventional technique includes a heavy current limiting busway which requires significant physical space. Still another conventional technique includes iron core reactors with cast-in-concrete construction. The current limiting busway and iron core reactor techniques present significant weight challenges and require a large amount of floor space.

It would therefore be desirable to provide an embodiment for handling fault current which is cost effective and not unreasonably heavy.

SUMMARY OF INVENTION

Briefly, in accordance with one embodiment of the present invention, a fault current limiter comprises: an air core flat clock spiral inductor comprising wound electrically conductive material and insulated turns; and two terminations configured for attaching the spiral inductor in series with a power carrying conductor.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
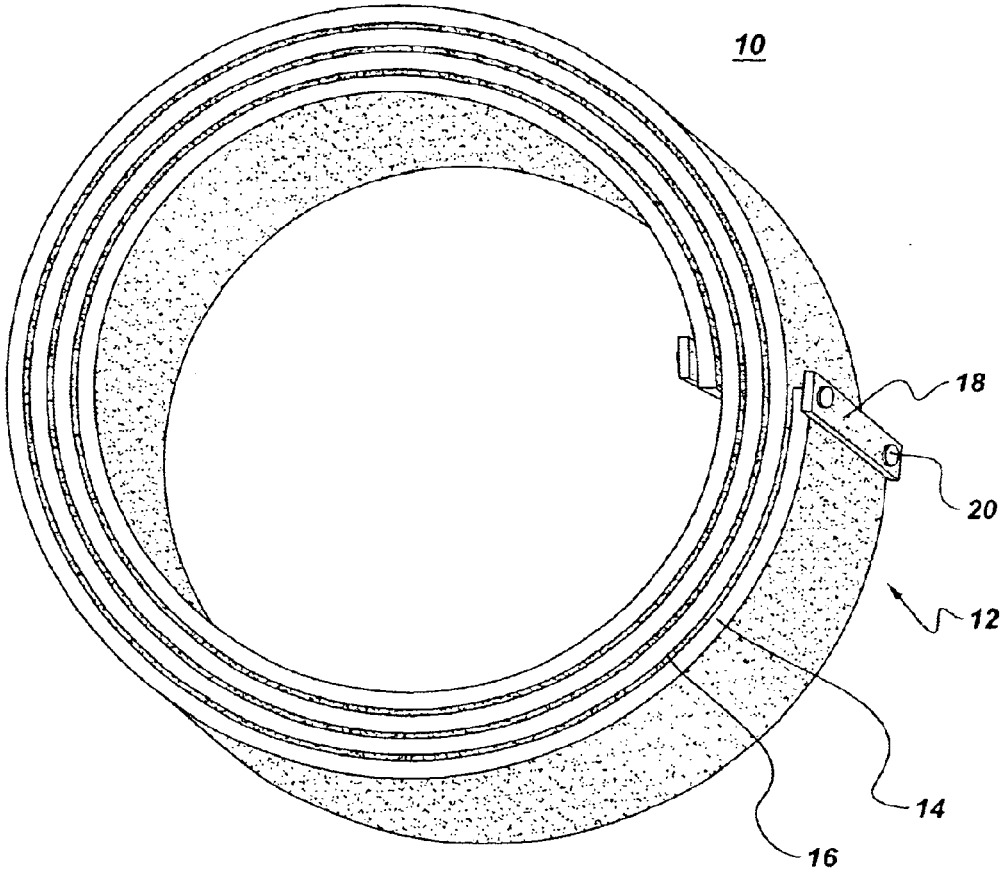
FIG. 1 is a perspective view of a fault current limiter in accordance with one embodiment of the present invention.

FIG. 1 is a perspective view of one embodiment of the present invention wherein a fault current limiter (FCL) 10 comprises: an air core 24 flat clock spiral inductor 12 comprising wound electrically conductive material 14 and insulated turns; and two terminations 18 (meaning at least two terminations) configured for attaching the spiral inductor in series with a power carrying conductor.

"Air core" is used to mean that the core (center) of the spiral inductor is not completely cast in a solid material, but "air core" is not meant to exclude the possibility that cooling apparatus, power connectors, structural support or other matter may be positioned with the core of the spiral inductor. "Flat clock" is used to mean that the winding spirals radially outwards as compared with solenoidal or coil type embodiments where the winding is axial. Although terminations 18 are shown as comprising plates for purposes of example, the terminations may comprise any opening in or addition to the spiral inductor for facilitating attachment. Other useful terminations include, for example, longer strips of electrically conductive materials than shown and cables. One example of a power carrying conductor for which the present invention is particularly useful is a busway. To enhance the mechanical and thermal properties of the interface between the spiral inductor and the terminations, in one embodiment, the combination of the wound electrically conductive material, the termination, and the power carrying conductor is configured such that any bends required for the configuration are gradual and typically include angles less than about 90 degrees. In a related, more specific embodiment, each end of the spiral inductor is coupled through two terminations or through two connections off one termination (not shown) which further distribute the current from the spiral inductor so as not to concentrate the current in one path and thus minimize current "crowding."

By introducing the correct level of inductive impedance in series with a fault, the fault current is limited to a lower, specified value enabling other equipment such as, for example, non-fused circuit breakers, in the system to optimally operate within normal device capabilities. Under normal operation the FCL has a minimal impact on efficiency and voltage regulation due to the FCL's inductive nature for a sufficiently high power factor load. "Sufficiently high power factor load" is meant to include power factors at least as high as necessary to limit the effect of the FCL voltage drop on system voltage to less than or equal to about 3 percent (using a root mean square). For example, when a 5000 ampere, 600 volt (line-to-line root mean square) system has an FCL with a power factor angle of about 86–87 degrees, it causes a voltage drop of about 20 volts. The resulting voltage drop is less than about one percent. The higher the power factor, the lower the resulting power drop. In one embodiment, the power factor is at least about 0.80. In a more specific embodiment, the power factor is at least about 0.85. The FCL is amenable to customization for a variety of system specifications at minimal development cost by adjusting the inductance to meet various steady state and fault current levels. The FCL may be optimally designed for minimum losses. For example, weight and thickness can be selected to minimize total losses of skin effects (rapid decreases in field intensity from the outer surface of the conductive material) and proximity effects on turns of the spiral inductor, on any nearby equipment and, if applicable, on other spiral inductors.

Figure 3:
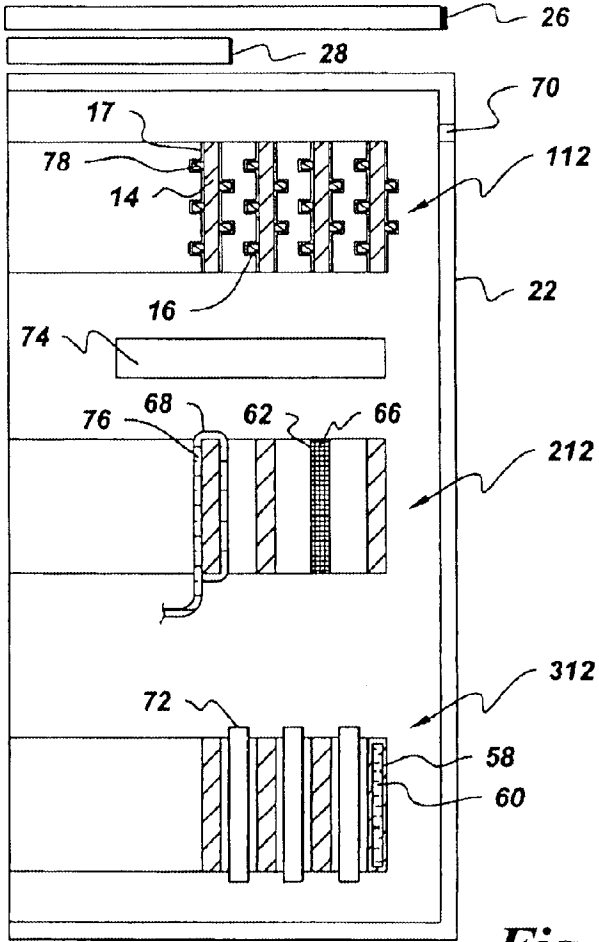
FIG. 3 is a sectional side view of a fault current limiter in accordance with related embodiments of the present invention.
Figure 2:
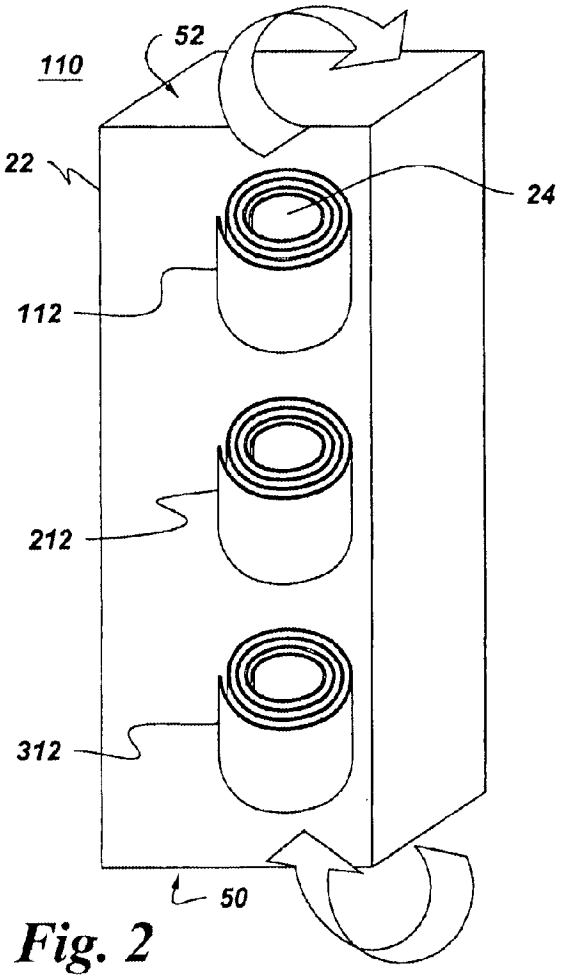
FIG. 2 is a schematic view of a fault current limiter in accordance with another embodiment of the present invention.

FIG. 2 is a schematic view of a fault current limiter in accordance with another embodiment of the present invention, and FIG. 3 is a sectional side view of a fault current limiter in accordance with related embodiments of the present invention. The embodiments shown in FIGS. 2–3 are for purposes of example only. In particular, FIG. 3 is used to selectively illustrate several examples of embodiments which, although capable of being used in a single embodiment, often would not be used in a single embodiment.

The electrically conductive material of the FCL may comprise any material capable of carrying the levels of current needed for a particular application in which the FCL will be used. Several examples of materials include conductive material is a metal, a metal alloy, and a conductive polymer. Several more specific examples include copper, aluminum, and combinations thereof. The optimal dimensions of the electrically conductive material for minimum electrical power loss depend upon the properties of the electrically conductive material, the frequency and temperature at which the FCL will be used, the amount of current which the FCL will experience. Minimizing electrical power loss in turn minimizes heat generation.

As discussed below, spacing between turns of the electrically conductive material may include insulative material, air, other fluids, cooling apparatus, or combination thereof. The distance and nature of inter-turn spacing are selected to be sufficient for electrically isolating the turns of the electrically conductive material and can be optimized for maximum heat transfer. Additionally, the number of turns in the inductor as well as the inter-turn spacing can be calculated for minimum weight to arrive at a given inductance value.

Figure 4:
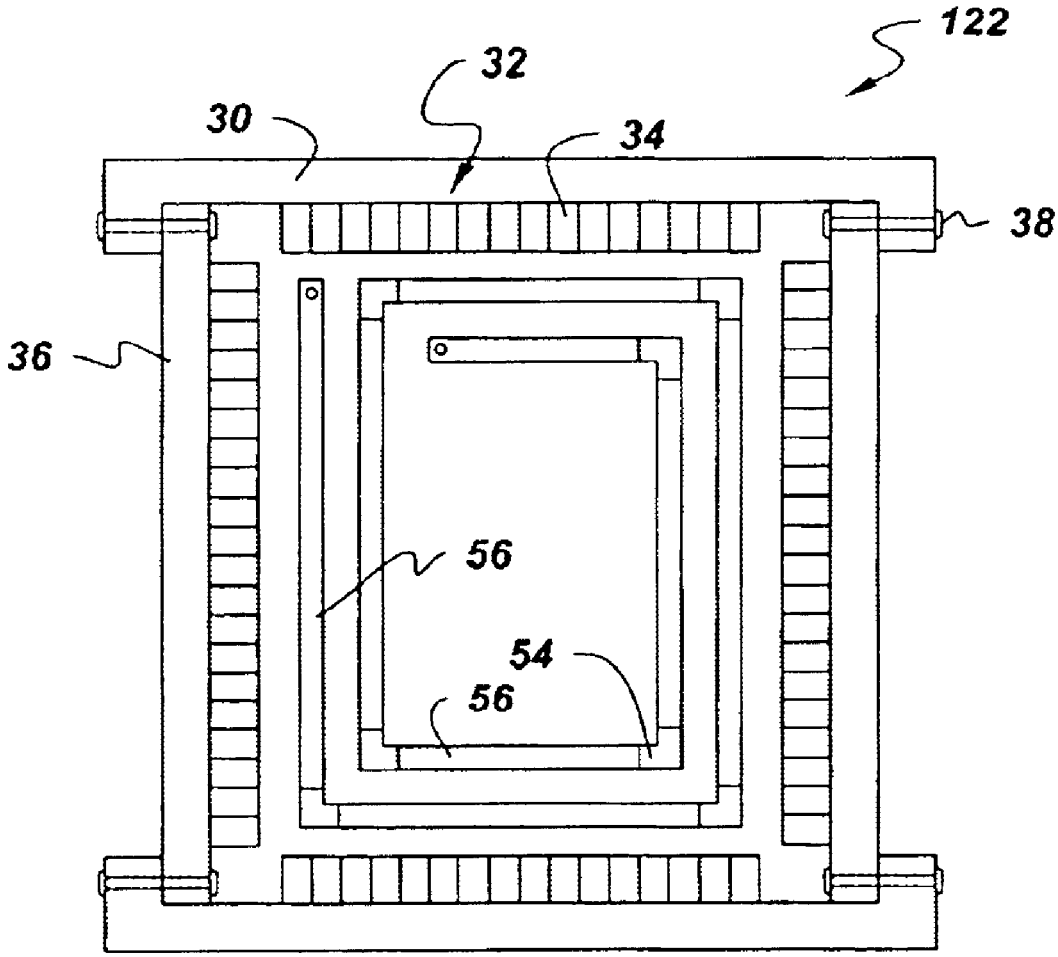
FIG. 4 is a sectional top view of a fault current limiter in accordance with another embodiment of the present invention.

In one embodiment, the wound electrically conductive material comprises a polygonal shape. As used herein, "polygonal shape" may include a shape comprising corners 54 (of any degree) such as shown in FIG. 4 or "polygonal shape" may include a continuous shape (having infinite sides) such as a round or oblong shape. In a more specific embodiment which can be useful material minimization, the spiral inductor comprises a cylinder.

In another more specific embodiment, the wound electrically conductive material 14 includes radially extending fins 78 as shown for purposes of example in FIG. 3. Fins 78 either are formed integrally to or are attached to electrically conductive material 14. Fins 78 may comprise any pattern with several examples including, straight strips, spiral strips, and discrete protrusions. By increasing the surface area of the wound electrically conductive material, the fins likewise increase the dwell time for any fluid passing therethrough (either through natural convection or through a cooling unit 26.

The wound electrically conductive material may comprise a multiple-turn wound sheet. Although four turns are shown in FIGS. 1–3, the present invention is not limited to a specific number of turns. As one alternative to a wound sheet, the wound electrically conductive material may alternatively comprise coupled segments 56 of electrically conductive material, as shown in FIG. 4, for example. Segments 56 are typically coupled by conventional abutting or interlocking braze joints. As another alternative to a wound sheet, the wound electrically conductive material may comprise stranded electrically conductive material (FIG. 3). Typically stranded electrically conductive material is formed by brazing strands 62 at each of two ends, insulating the strands, and curing the insulation, for example. The strands may comprise any desired shapes. Optionally, at least one strand 62 of the stranded electrically conductive material comprises a hollow strand. In a more specific embodiment, a fluid 66 is provided within the hollow strand. Regardless of whether strands are used, the electrically conductive material may comprises at least one opening 58 extending therethrough. In a similar manner, the FCL may further comprise a fluid 60 within the opening.

In one embodiment, the FCL further comprises fluid 76 between turns of the electrically conductive material. The fluid may optionally be contained within a casing 68 such as a tube wrapped around the electrically conductive material. Alternatively, the fluid may be present without a casing. The fluid may comprise a liquid, gas, or, if a casing is used, a combination thereof. Several examples of fluids include air, helium, oil, and water.

In an additional or alternative embodiment, the wound sheet of electrically conductive material further comprises a insulation layer 17 on at least one surface of the electrically conductive material. For increased insulation, insulation layer 17 may optionally be situated on both surfaces of the electrically conductive material. The insulation layer may comprise thermoset or thermoplastic materials having temperature and dielectric properties capable of withstanding the intended operating environment.

In one embodiment, the insulation layer comprises a powder coating. The powder coating may comprise a resin, for example. More specific examples of resins include epoxy, polypropylene, polyethylene, polyvinyl chloride, polyetheretherketone, polyetherketoneketone, acrylic urethane, polyester, silicone epoxy, polyester resin with triglycidyl isocyanurate curing (TGIC) agents or combinations thereof, for example. When resins are used for powder coating, useful properties include, for example, sufficient adhesion, hydrolytic stability, flexibility, abrasion resistance, breakdown strength, and thermal conductivity. Example coating techniques include, for example, immersing the electrically conductive material in a fluidized bed, applying a powdered uncured resin by electrostatic spraying, and using an electrostatic fluidized bed.

In other embodiments, the insulation layer may comprise an insulating tape comprising a material such as silicone, glass, an aramid, polyolefin, polyester, polyimide, polypropylene, polyethylene, polyvinyl chloride, polyetheretherketone, polyetherketoneketone, acrylic urethane, polyester resin with triglycidyl isocyanurate curing (TGIC) agent, or combinations thereof, for example, or a shrink wrap comprising materials such as a polyolefin or a polytetrafluoroethylene, for example.

In some embodiments, it is useful for the FCL to further comprise a housing 22 surrounding the spiral inductor, the housing comprising walls. A housing is not necessary in all embodiments. In embodiments wherein no field interference is expected to result, a FCL design may be most cost effective without a housing. Several options include securing the FCL outside in a fenced area or in a room sufficiently distant from other equipment.

Housing 22 may be used for mechanical support, containment, or both. Depending upon the selected materials and construction, the housing can additionally or alternatively be used for shielding magnetic flux and heat generated by the spiral inductor. Shielding is useful for preventing damage to neighboring equipment. "Walls" 30 of the housing as used herein are meant to include all walls whether "side," "top," or "bottom" and need not be completely solid. In one embodiment, for example at least one of the walls comprises at least one vent 70. Vent 70 may comprise any suitable opening, examples of which include louvers and screens. The shape of the housing may comprise any appropriate shape. In one example, the housing comprises a polygonal shape which, as discussed above may comprise a cornered or rounded shape.

In some embodiments, at least one of the walls comprises a metal material. Standard cabinet type housings, for example, typically comprise steel having a thickness of about 0.48 centimeters. When each one of the walls is in electrical contact with the other walls, heating of the walls will occur due to eddy currents unless flux leaking from the FCL is shunted away from the walls. In one embodiment wherein the housing further comprises at least one stack 32 of magnetic laminations 34 between at least one of the walls and the three air core spiral inductors, flux can be shunted. Typically the laminations comprise iron and extend perpendicularly about 0.63 centimeters to about 2.54 centimeters from the wall surface. Laminations may be situated in any appropriate manner examples of which include a press fit, a bracket, banding, or combinations thereof.

In some embodiments, at least one of the walls comprises a non-magnetic material. Using a non-magnetic material reduces eddy currents. If the non-magnetic material comprises a metallic, non-magnetic material such as aluminum or copper, magnetic flux effects will be reduced. Alternatively, to further reduce eddy current, the non-magnetic material may comprise an insulating material. However, with an insulating material, magnetic flux can propagate.

In one embodiment, a combination of magnetic and insulating materials are used. This embodiment can be facilitated as shown in FIG. 4, for example, by fastening the walls with fasteners 38. If wall 36 comprises an insulating material and wall 30 comprises a magnetic material, any sensitive electrical equipment in the vicinity can be optimally positioned facing wall 30 as opposed to wall 36. The insulating material may comprise non-conductive polymer or a composite with physical integrity such as polyofin, for example.

Figure 5:
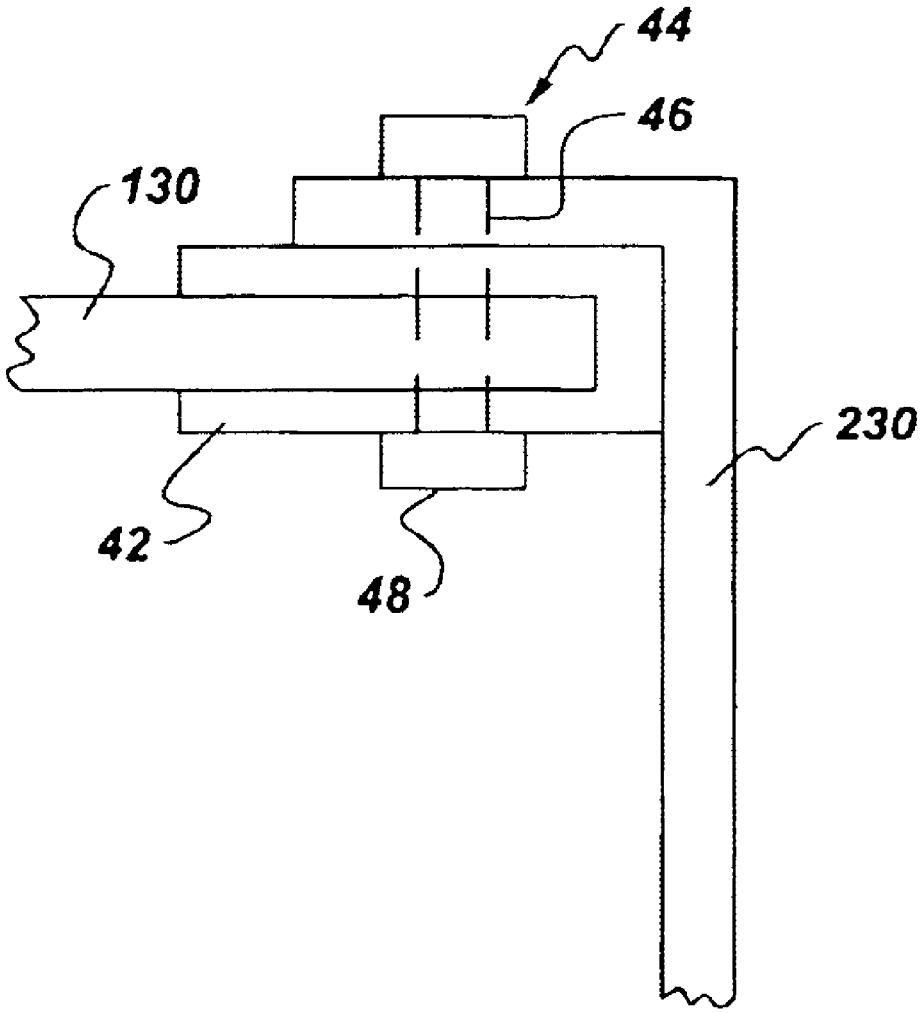
FIG. 5 is a top view of a section of housing in accordance with another embodiment of the present invention.

In another embodiment, each one of the walls is electrically isolated from the other walls via an insulative coupling. FIG. 5 is an example of one type of insulative coupling wherein electrical insulator 42 is present between two adjacent walls 130 and 230 and a non-conductive fastener 44 holds the walls in contact. In one embodiment, fastener 44 comprises a bolt 46 with nuts 48. Example materials for the non-conductive fastener include wood and plastic, for example. The above-described embodiment of the housing further comprising at least one stack of magnetic laminations 34 between at least one of the walls and the three air core spiral inductors is also useful when the walls are electrically isolated.

FIGS. 2–3 illustrate an embodiment wherein the air core spiral inductor comprises a plurality of air core spiral inductors 112, 212, 312, with each one of the plurality of air core spiral inductors comprising a wound sheet of electrically conductive material and insulated turns and with each spiral inductor situated within the housing. The embodiment of FIG. 3 is for purposes of example only. The spiral inductors need not be vertically stacked and need not be oriented in the same manner with respect to each other. Having cores of the spiral inductors facing the same direction can be useful, however, when using fans for air cooling. Even in such embodiments, the spiral inductors need not be precisely aligned. For example, one or more of the spiral inductors may have a different diameter, whether inner, outer or both, than the other spiral inductors. It is also useful to select an orientation by taking consideration ease of connection to the power conductor.

In a more specific embodiment, the plurality of air core spiral inductors comprises three air core inductors, and each one of the three air core spiral inductors is configured to be coupled to a separate phase of the power carrying conductor. In another embodiment, at least some of the plurality of air core spiral inductors are configured to be coupled to a single phase of the power carrying conductor.

Mechanical support for the plurality of spiral inductors may comprise any appropriate structural material and design which electrically separates the inductors from each other and from any electrically conductive walls, is structurally strong enough to support the weight of the spiral inductors, and can keep the inductors steady in the event of a fault. One example material is powder-coated steel. Optimally, mechanical support can be designed to leave enough space for efficient cooling. In one embodiment, at least one magnetic shield 74 is provided between at least two of the plurality of spiral inductors. Magnetic shield 74 may comprise either a portion of a mechanical support or a separate element of the FCL.

To help with heat dissipation, in one embodiment, the FCL further comprises at least one cooling unit 26 configured for cooling the spiral inductors. In a more specific embodiment, the cooling unit is a fan, an air conditioner, an auxiliary cooling unit or a combination thereof.

In an embodiment wherein fans are used and a housing is present, the housing comprises at least two separate fan openings 50, 52, and the cooling unit comprises at least two fans, each configured to provide cooling air through a respective one of the at least two separate fan openings. In some embodiments it is useful for the housing openings, baffles 28, ducting, or a combination of such elements to channel air in a manner to provide a minimal temperature differential amongst the spiral inductors. Even in embodiments wherein thermal independence is not a goal, it is useful to direct the air along the electrically conductive material of the spiral inductors as compared with directing the air through the cores.

Auxiliary cooling units include units, for example, that control other types of cooling arrangements such as fluid cooling or heat pipe type cooling arrangements. In one embodiment, the FCL comprises at least one heat pipe 72 (FIG. 3), and the auxiliary cooling unit comprises a heat pipe controller. Typically, in heat pipe embodiments, a separate set of heat pipes will be used for each spiral inductor. In an alternative heat pipe embodiment, a set of heat pipes can be shared by multiple inductors. In another embodiment, as discussed above wherein fluid 76 is situated between turns of the electrically conductive material, the auxiliary cooling unit controls cooling of fluid 76. In another embodiment wherein the electrically conductive material comprises at least one opening 58 extending therethrough, and the FCL comprises a fluid 60 within the opening, the auxiliary cooling unit controls cooling of fluid 60.

EXAMPLE DESIGN

In one specific, non-limiting embodiment which is presented only for purposes of example with respect to a 600 volt, 5000 kA, 60 Hz system, a three-phase FCL is designed to be situated within an approximately 1 meter wide, 2.3 meter tall housing. To keep each phase of the FCL in the range of about 180 kilograms to about 230 kilograms, the spiral inductor is designed to comprise copper with a width of about 25.4 centimeters, a thickness ranging from about 10.16 millimeters to about 11.43 millimeters, an inner diameter of about 58 centimeters, an outer diameter of about 70 centimeters, and inter-turn spacing of about 16 millimeters. The predicted total three phase losses are calculated to be about 14.23 kilowatts (about 4.7 kW for the top inductor, about 4.83 kW for the middle inductor, and about 4.7 kW for the bottom inductor).

In the above example design, the desired inductance was predicted to be about 9.54 microhenries per phase. With such inductances, it is expected that a 600 volt (line-to-line, root mean square), 5 kA (kiloamps) system can have a short circuit current reduced from about 200 kA to about 65 kA. The calculated inductances were about 10.68, 10.17, and 10.68 microhenries, respectively. The slightly higher inductance values of the top and bottom inductors results from the top and bottom inductors being further apart and influencing each other less as compared with the top and middle inductors or the bottom and middle inductors. If desired, the dimensions of the middle inductor can be changed such that all inductors have the same effective inductance. In the above design example, the expected phase voltage drop is about 20 volts at about 87 degrees. With a load at 0.9 PF (power factor), about 2.6% regulation (voltage drop) will result. Such regulation is under the limit of 3%.

The value of 9.54 microhenries per phase was obtained by determining the desired impedance for the expected fault current and the voltage of the system. For example, if a 200 kA fault current is expected, the impedance for the air core inductor is 2.88 milliohms at 480 V and 3.60 milliohms at 600 V. More specifically, for the 600 V example, if no inductor is present, the root mean square phase voltage (346V) divided by 200 kA results in a system impedance of about 1.732 milliohms. If a fault current of 65 kA is desired, the total impedance needed will be the root mean square voltage divided by 65 kA or about 5.323 milliohms. Subtracting the 1.732 milliohms from the 5.323 milliohms results in 3.60 milliohms. If the entire FCL is inductive, then the inductance equals impedance divided by 2 $\pi f$, wherein f represents frequency. The above impedances translate into about 7.634 microhenries at 480 V and about 9.542 microhenries at 600 V for 60 Hz systems. At very high frequencies, it is expected that the inductance value will be slightly reduced due to skin effects. For example, it is expected that the inductance will be reduced by about 5.5% at 60 Hz. The predicted resistance was calculated to be about 0.158 milliohms at 60 Hz. The impedance angle was calculated to be about 87.6 degrees at 60 Hz. The efficiency penalty is expected to be negligible. For a 5196 kVA system, the expected penalty of about 5 kA results in losses that are only about 0.274%.

The previously described embodiments of the present invention have many advantages, including a more compact, lightweight, and efficient design as compared with conventional embodiments. By using a fault current limiter of the present invention, faults on the order of 200 kA can be limited to about 65 kA, thereby allowing the use of smaller, less-expensive circuit breakers. Still another advantage of the FCL over conventional techniques is that the FCL, as an air-core device, avoids the magnetic saturation issues experienced by an iron core reactors. Furthermore, embodiments of the present invention can be used to provide a passive, simple, and rugged device which is thus highly reliable from electrical, mechanical, and thermal standpoints.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A fault current limiter (FCL) comprising:

an air core flat clock spiral inductor comprising wound electrical conductive material insulated turns;

a casing containing fluid between the turns of the air core flat clock spiral inductor, wherein the casing comprises a tube wrapped around the electrically conductive material;

two terminations of the FCL.

2. A fault current limiter (FCL) comprising:

an air core flat clock spiral inductor comprising wound electrically conductive material insulated turns;

two terminations of the FCL, wherein the wound sheet of electrically conductive material further comprises an insulation layer on at least one surface of the electrically conductive material, wherein the insulation layer comprises a shrink wrap.

3. The FCL of claim 2 wherein the shrink wrap comprises a polyolefin or a polytetrafluoroethylene, for example.

4. A fault current limiter (FCL) comprising:

an air core flat clock spiral inductor comprising wound electrically conductive material and insulated turns;

two terminations of the FCL, a housing surrounding the spiral inductor, the housing comprising walls, wherein each one of the walls is in electrical contact with at least one other one of the walls, wherein the housing further comprises at least one stack of magnetic laminations between at least one of the walls and the spiral inductor.

5. A fault current limiter (FCL) comprising:

an air core flat clock spiral inductor comprising wound electrically conductive material and insulated turns;

two terminations of the FCL, further comprising a housing surrounding the spiral inductor, the housing comprising walls, wherein the housing further comprises at least one stack of magnetic laminations between at least one of the walls and the spiral inductor.

6. A fault current limiter (FCL) comprising:

an air core flat clock spiral inductor comprising wound electrically conductive material an insulated turns;

two terminations of the FCL;

a housing surrounding the spiral inductor, the housing comprising walls, wherein the air core spiral inductor comprises a plurality of air core spiral inductors, with each one of the plurality of air core spiral inductors comprising a wound sheet of electrically conductive material and insulated turns and situated within the housing; and at least one magnetic shield between at least two of the plurality of spiral inductors.

7. A fault current limiter (FCL) comprising:

an air core flat clock spiral inductor comprising wound electrically conductive material and insulated turns;

two terminations of the FCL;

at least one auxillary cooling unit configured for cooling the spiral inductor and comprising a fan, an air conditioner, an auxillary cooling unit, or a combination thereof;

at least one heat pipe, wherein the auxiliary cooling unit comprises a heat pipe controller.

8. A fault current limiter (FCL) comprising:

three air core flat clock spiral inductors, each inductor comprising a cylindrically wound sheet comprising copper and a insulation layer on at least of the copper;

a housing surrounding the three air core inductors the housing comprising wall; and at least one cooling unit configured for providing cooling air to the three spiral inductors of the FCL, wherein the housing further comprises at least one stack of magnetic laminations between at least one of the walls and the air core spiral inductors.

9. A fault current limiter (FCL) comprising:

three air core flat clock spiral inductors, each inductor comprising a cylindrically wound sheet comprising copper and a insulation layer on at least one surface of the copper;

a housing surrounding the three air core spiral inductors, the housing comprising wall; and at least one cooling unit configured for providing cooling air to the three spiral inductors of the FCL; and at least one magnetic shield between at least two of the three of spiral inductors.

* * * * *

UNITED STATES PATENT AND TRADEMARK OFFICE

CERTIFICATE OF CORRECTION

PATENT NO. : 6,873,236 B2
DATED : March 29, 2005
INVENTOR(S) : Manoj R. Shah et al.

It is certified that error appears in the above-identified patent and that said Letters Patent is hereby corrected as shown below:

Column 8,
Line 44, please delete "copper and insulation layer on at least of the copper" and insert -- copper and insulation layer on at least one surface of the copper --

Signed and Sealed this

Ninth Day of August, 2005

JON W. DUDAS
*Director of the United States Patent and Trademark Office*